US005235936A

United States Patent [19]

Kracklauer

[11] Patent Number: 5,235,936

[45] Date of Patent: Aug. 17, 1993

[54] FERROCENE INJECTION SYSTEM

[76] Inventor: John J. Kracklauer, 2995 Wilderness Pl., Boulder, Colo. 80301

[21] Appl. No.: 986,868

[22] Filed: Dec. 4, 1992

[51] Int. Cl.[5] ..... F02B 75/12

[52] U.S. Cl. ..... 123/1 A; 431/4; 123/23; 44/361

[58] Field of Search ..... 123/1 A, 23; 431/4; 44/361

[56] References Cited

U.S. PATENT DOCUMENTS

| | | | |
|---|---|---|---|
| 2,867,516 | 1/1959 | Pedersen | 48/197 |
| 3,783,841 | 1/1974 | Hirschler, Jr. et al. | 123/1 A |
| 3,886,007 | 5/1975 | Combs, Jr. et al. | 149/19.2 |
| 4,070,212 | 1/1978 | Mackey et al. | 149/19.9 |
| 4,222,746 | 9/1980 | Sweeney et al. | 123/1 A |
| 4,295,816 | 10/1981 | Robinson | 431/4 |
| 4,318,760 | 3/1982 | Stephens et al. | 149/19.9 |
| 4,389,220 | 6/1983 | Kracklauer | 44/57 |
| 4,416,710 | 11/1983 | Anderson | 149/19.91 |
| 4,525,174 | 6/1985 | Croudace | 123/1 A |
| 4,612,880 | 9/1986 | Brass et al. | 123/1 A |
| 4,946,609 | 8/1990 | Pruess et al. | 252/35 |
| 4,952,289 | 8/1990 | Ciccone et al. | 423/219 |
| 4,955,331 | 9/1990 | Hohr et al. | 123/1 A |
| 4,998,876 | 3/1991 | Farrar | 431/4 |
| 5,113,804 | 5/1992 | Kraus et al. | 123/1 A |
| 5,118,282 | 6/1992 | Reynolds et al. | 431/4 |

FOREIGN PATENT DOCUMENTS

| | | | |
|---|---|---|---|
| 3715473 | 8/1988 | Fed. Rep. of Germany . | |
| 0746036 | 3/1956 | United Kingdom | 44/361 |

OTHER PUBLICATIONS

Schug, K. P., Guttmann, H. J., Preuss A. W.; Schädlich, K., "Effects of Ferrocene as a Gasoline Additive on Exhaust Emissions and Fuel Consumption of Catalyst Equipped Vehicles", SAE Technical Paper Series No. 900154 (1990).

*Primary Examiner*—E. Rollins Cross
*Assistant Examiner*—Erick Solis
*Attorney, Agent, or Firm*—Kyle W. Rost

[57] ABSTRACT

A passive ferrocene injection system provides a container that defines an internal reservoir holding a quantity of solid phase ferrocene. A means is provided for maintaining an elevated reservoir temperature sufficient to produce a vapor of ferrocene. The reservoir is connected to the air inlet system of a combustion device in such a manner that the ferrocene vapor is metered into the air inlet stream. One portion of this connection is a flow orifice metering ferrocene vapor from the reservoir at least by diffusion, and more normally, by diffusive and convective transport mechanisms.

20 Claims, 1 Drawing Sheet

FERROCENE INJECTION SYSTEM

TECHNICAL FIELD

The invention generally relates to internal combustion engines. More specifically, the invention relates to fuels, lubricants and additives. Another aspect of the invention generally relates to combustion and more specifically to processes of combustion or burner operation, especially to feeding a flame modifying additive. Specifically disclosed is a ferrocene injection system for improving combustion of solid, liquid or gas fueled equipment, or any combustion process using air or oxygen.

BACKGROUND ART

Dicyclopentadienyl iron, also known as ferrocene, has efficacy when used as a fuel additive to improve combustion quality, reduce pollutant emissions and increase efficiency in fuel combustion systems, including engines, boilers and turbines. For example, U.S. Pat. No. 2,867,516 to Pedersen discloses that ferrocene can be used as a combustion aid in vapor phase as an addition to gaseous hydrocarbon fuel, or as an addition to the air or oxygen employed in supporting combustion. According to the Pedersen patent, heated fuel, air or oxygen can be passed through a bed of ferrocene crystals to vaporize ferrocene and entrain it into the fuel mixture. This type of sublimer is intended to supply the ferrocene and fuel in a predetermined ratio, such as 1:20 to 1:2000 parts by weight of fuel. The patent discloses that when ferrocene is supplied in suitable concentration, the quality of the combustion process is improved, resulting in cleaner combustion products.

Another known use of ferrocene is as a fuel additive, serving as an engine conditioner. U.S. Pat. No. 4,389,220 to Kracklauer discloses a two-stage method of conditioning a diesel engine, resulting in reduced pollutant emissions and increased efficiency in fuel combustion. An initial high dosage of ferrocene, such as 20–30 ppm, in the diesel fuel eliminates carbon deposits from the combustion chambers and deposits a layer of catalytic iron oxide on the combustion surfaces. Thereafter, a lower dosage of ferrocene, such as 10–15 ppm, maintains the catalytic iron oxide coating. It is undesirable to maintain the initial high concentration of ferrocene in diesel fuel, as this will lead to detrimental combustion modifications, minimizing or eliminating the beneficial effects of the catalytic iron oxide wall coating. Therefore, the mere addition of ferrocene to fuel is not entirely satisfactory as a delivery system.

The addition of ferrocene to fuel also is known to enhance gasoline's octane rating. In addition, ferrocene is known to reduce certain exhaust emissions and decrease fuel consumption in gasoline powered vehicles. Schug, K. P., Guttann, H. J., Preuss, A. W., and Schadlich, K., *Effects of Ferrocene as a Gasoline Additive on Exhaust Emissions and Fuel Consumption of Catalvst Equipped Vehicles,* SAE Technical Paper Series, 1990, paper number 900154.

While ferrocene typically is dissolved in liquid fuel, systems have been devised to deliver other catalytic combustion aids through the air stream into an engine's combustion chamber. For example, U.S. Pat. No. 5,113,804 to Kraus discloses a system for handling a solid phase catalyst consisting of a platinum compound. A metered quantity of the compound is mechanically dispensed onto a heated plate, where it is sublimed and joins the combustion air stream. The metering apparatus is responsive to various parameters, such as fuel consumption rate or emission rate from the combustion process of certain compounds. Addition of a proper concentration of catalyst by this system decreased exhaust emissions of hydrocarbons and produced a lighter color in the engine's exhaust smoke.

As shown, considerable effort has been directed to supplying ferrocene or other catalysts in the combustion mixture in a proper proportion to reduce emissions and condition the engine. With increasing pollution control requirements applicable to combustion equipment, it would be desirable to have a simple and reliable method and apparatus to supply ferrocene in an effective amount. For example, the injection of liquid ferrocene solution into the combustion system of an engine would be desirable. However, the solubility of ferrocene in solvent is limited to about ten percent by weight. With this limited solubility, it would be difficult to carry a large enough reservoir of ferrocene solution on a motor vehicle for long term injection. Similarly, the direct solution of ferrocene in gasoline or diesel fuel is not fully satisfactory, since no single concentration is correct in all cases. In addition, treating each tank of fuel at fill-up is difficult and cumbersome.

Therefore, it would be desirable to have a method and apparatus for supplying ferrocene to an engine other than as an additive to fuel or lubricating oil.

Similarly, it would be desirable to have a method and apparatus for supplying ferrocene in suitable quantity without requiring costly and complex sensors and the like combustion monitoring equipment to meter and regulate the process.

In addition, it would be desirable to have a method and apparatus for supplying ferrocene to a combustion system in a manner that results in improved effectiveness.

To achieve the foregoing and other objects and in accordance with the purpose of the present invention, as embodied and broadly described herein, the method and apparatus of this invention may comprise the following.

DISCLOSURE OF INVENTION

Against the described background, it is therefore a general object of the invention to provide an improved apparatus for supplying ferrocene vapor into the inlet air stream of a combustion device, such as an engine, boiler, or turbine. In particular, an object is to provide a passive device that supplies ferrocene vapor in an average dose relative to the average fuel throughput of the combustion device.

A more specific object is to provide an apparatus and method for supplying ferrocene primarily by convective and diffusive metering techniques, through a flow orifice. Such an orifice can provide variation in delivery rate according to changes in convective transport mechanism but does not require sophisticated sensors and controls.

Still another object is to provide a ferrocene injector that can first condition an engine by delivering a relatively higher dose of ferrocene vapor, and then later maintain the conditioning of the engine by delivering a relatively lower dose.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a passive ferrocene injection system provides a container that defines an internal reservoir holding a quantity of solid phase ferrocene. A means is provided for maintaining a fixed or controlled elevated reservoir temperature sufficient to produce a specific and repeatable vapor pressure of ferrocene in the reservoir. The reservoir is connected to the air inlet system of a combustion device in such a manner that the ferrocene vapor is supplied directly into the air inlet stream. A key element of this connection is a flow orifice metering ferrocene vapor from the reservoir at least by a diffusive flow mechanism and normally by a diffusive/convective flow mechanism.

Another aspect of the invention provides a passive method for delivering ferrocene to the combustion zone of a combustion device having an inlet air stream. First, a reservoir is provided, containing a quantity of solid phase ferrocene. This reservoir is maintained at a temperature producing a specific and repeatable vapor pressure of ferrocene. The vapor is metered by a flow orifice between the reservoir and the inlet air stream of a combustion device. The orifice is sized to supply an average ferrocene dose relative to the average fuel throughput of the combustion device.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
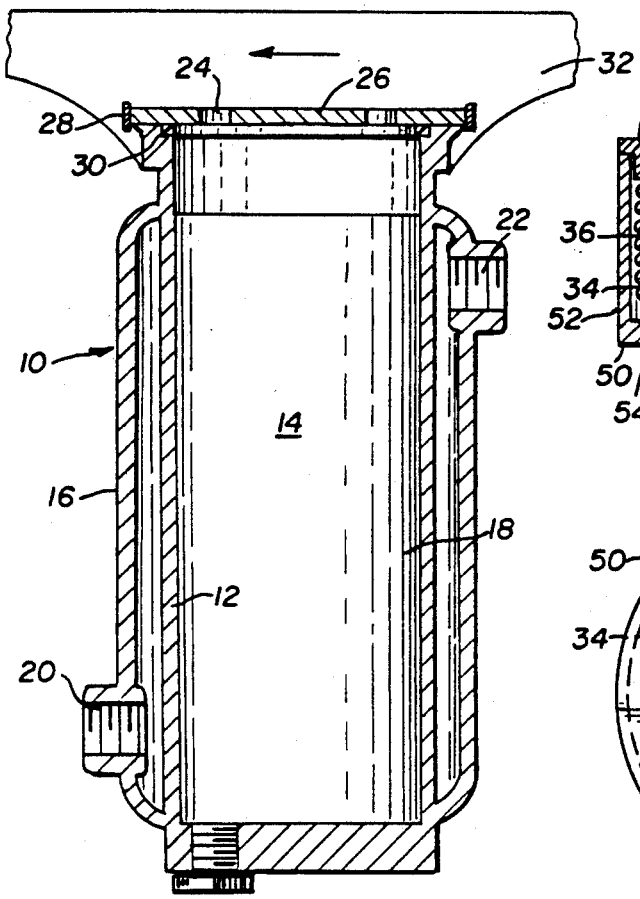
FIG. 1 is a side view in cross-section, showing a first embodiment of the injection system.

The invention is a ferrocene injection system and method of operation, suitable for use in combination with combustion systems such as engines, boilers and turbines. Ferrocene, which also is known as dicyclopentadienyl iron, increases efficiency in combustion systems, especially as a fuel additive. The new apparatus and method improves upon the known properties of ferrocene by supplying this compound in a simplified fashion and with an unexpected improvement in performance.

This invention is in part based upon the discovery that ferrocene functions in an improved manner as a combustion modifier when pre-mixed as a vapor with the inlet air stream rather than being mixed with the fuel. Further, ferrocene functions in an improved, long term manner when it forms a coating of catalytic iron oxide on the surfaces of a combustion zone. Thus, this invention is based upon the theory that it is not necessary to vary the supplied dose of ferrocene in response to instantaneous changes in fuel flow or combustion rate. Instead, ferrocene can be supplied on a long term basis in an average dose based upon the average fuel throughput of an engine. Thus, the invention offers improved performance in the first totally passive apparatus and method for supplying ferrocene to an engine, as no sophisticated control mechanism is required.

It has been discovered that the method by which ferrocene is delivered to a flame can strongly influence its effectiveness as a combustion catalyst. For example, direct addition of ferrocene to a 100% aromatic fuel such as benzene results in a barely perceptible reduction in particulate emission when the benzene so treated is burned in a wick type flame. In a different example, ferrocene powder can be placed in a horizontal tube leading from a bubbler to a nozzle. Air passing through the bubbler is saturated with benzene and then directed through the tube to the nozzle, where the saturated air/benzene mixture is ignited. This flame will burn with massive black smoke generation as long as the ferrocene crystals in the benzene saturated air stream are maintained at room temperature, which results in a low effective ferrocene concentration in the air/fuel mixture. However, if a bunsen burner is placed under the ferrocene crystals in the tube to increase the vaporization rate of the ferrocene into the air/fuel mixture, the flame will be catalytically modified so that it is completely smoke free. These examples demonstrate that ferrocene is a more effective combustion catalyst when pre-mixed with the air in a fuel combustion environment than when pre-mixed with the fuel. This discovery is one of the enabling principals of the new ferrocene injector and method.

The second principal is that ferrocene is thermally and oxidatively stable to 500° C. In addition, it exhibits a pure component vapor pressure which is described by the following two equations:

| | |
|---|---|
| For solid: | Log P(mm Hg) = 10.27 − 3680/T(°K.) |
| For liquid: | Log P(mm Hg) = 7.615 − 2470/T(°K.) |

Consequently, ferrocene is unique among organometallic materials in that it can be added to an air stream simply by maintaining a reservoir containing the solid ferrocene at a relatively constant elevated temperature by sublimation. This will generate a fixed concentration of ferrocene vapor in the reservoir, which allows a combination of thermal diffusion and air stream convection to be used to meter the vapor phase ferrocene to the air stream. This is the second underlying principal of the new ferrocene injector and method.

The following are physical properties of ferrocene:

TABLE 1

PHYSICAL PROPERTIES OF FERROCENE

| | |
|---|---|
| Formula: | $(C_5H_5)_2Fe$ |
| Molecular Weight: | 186.04 |
| Melting Point: | 173° C. (343° F.) |
| Boiling Point: | 249° C. (480° F.) at 760 mm Hg |
| Vapor Pressure: | |
| at 40° C. | 0.03 mm Hg |
| at 100° C. | 2.6 mm Hg |
| Magnetic Susceptibility: | Diamagnetic |
| Heat of Formation | $\Delta H_f$ at 25° C. = 33.8 Kcal/gm-mole |
| Heat of Fusion: | 5.5 Kcal/gmmole |
| Heat of Vaporization: | 11.3 Kcal/gm-mole |
| Heat of Sublimation: | 16.8 Kcal/gmmole |

TABLE 1-continued

| PHYSICAL PROPERTIES OF FERROCENE | |
|---|---|
| Solubility: | |
| Solvent | g/100 g Solvent at 25° C. |
| Benzene | 19 |
| Xylene | 11 |
| Amyl Benzene | 11 |
| Catalytically Cracked Gasoline | 10 |
| Straight Run Gasoline | 9 |
| Gasoline Blend: | |
| 70% Cat. Cracked/30% Str. Run | 7 |
| Jet Fuel (JP-4) | 7 |
| n-Heptane | 6 |
| Diesel Fuel | 5 |
| Kerosene | 5 |

FIG. 1 of the drawings shows an injector apparatus 10 that has been developed to deliver ferrocene into an intake air stream of an engine in accordance with the method of the invention. The body of the injector 10 is a cup or similar container 12 holds a quantity of solid phase ferrocene 14 in a reservoir defined therein. The preferred form of the ferrocene is powder, crystalline, solid, or solidified in place from a melt. Ferrocene can be obtained in either high or low purity. For efficiency of volume, it is preferred that the ferrocene be of at least 95% minimum purity. However, much lower purity can be used with no loss of performance, since ferrocene of lower purity will vaporize to produce the same partial pressure within the ferrocene reservoir.

The container 12 is provided with a means for maintaining an elevated reservoir temperature sufficient to produce a specific and repeatable vapor pressure of ferrocene in the reservoir. A specific, repeatable vapor pressure is achieved as a function of temperature. Therefore, ferrocene must be maintained at a temperature above ambient in order to produce specific, repeatable vapor pressure. As one example, the container may be fitted with a jacket 16 surrounding the sides and bottom of the reservoir and adapted to receive and contain a hot fluid, such as engine coolant or engine lube oil. The hot fluid will maintain a reasonably constant temperature in the reservoir 18 defined within the container 12 and containing the ferrocene. Specifically, engine coolant often is heated to about 170°-200° F. Engine oil may be somewhat hotter. However, engine fluids typically are operated at temperatures below ferrocene's the melting point of 343° F., 173° C. A fluid inlet 20 and outlet 22 allow a constant circulation of the liquid between the jacket and the engine as long as the engine is operating. References to elevated temperature and hot fluids should be understood to refer to temperatures above ambient temperature, such as above 100° F. and preferably in the approximate area of 170°-200° F. and above, but below the decomposition point of 500° C. and preferably below the ferrocene's boiling poiny of 249° C., 480° F.

The reservoir 18 is connected directly to the air inlet system for the engine through a properly sized critical flow orifice 24. The metering process for delivering or injecting the vapor phase ferrocene to the engine relies upon a combination of diffusion and convection mechanisms. The diffusion mechanism maintains the ferrocene vapor concentration on the reservoir side of the orifice. A coupled diffusive/convective mechanism operates through the metering orifice in plate 24, which is exposed directly to the inlet air stream, and functions by transport from the ferrocene-saturated vapor at the reservoir to the ferrocene-free background air of the inlet air stream. The convection transport mechanism operates by interaction with air stream convection currents in the inlet stream, which are external to the injector. Thus, the orifice 24 is sized to anticipate a combination of convective and diffusive transport mechanisms. Since the primary efficacy of ferrocene is to modify the fuel combustion process, the average ferrocene dose relative to the average fuel throughput of the engine can be calculated and used as a basis for sizing the diffusion/convection orifice 24 of the injector. No other control mechanism is required in this passive system.

The convective/diffusive orifice may be formed in a separate plate 26 that closes the top of the container 12. A suitable clamp 28 may hold the plate in place. In addition, an O-ring seal 30 is located between the plate and the container body.

Injector 10 is connected to the engine air inlet system by a suitable means for this purpose. The connection is achieved by locating the plate 26 in the inlet air stream, so that the reservoir can supply ferrocene vapor to the air stream through the plate, at least by diffusion. Thus, the connection may be achieved simply by locating plate 26 of the injector in a wall of the inlet air passageway or duct 32. Generally, the preferred location for this connection is behind the air filter but before the turbo, if any. Thus, the connecting means defines the flow orifice metering ferrocene vapor at least by diffusion. The degree of metering by convection may depend upon the physical structure of the air inlet system and upon location of the orifice within that system. Thus, while convection is important to the mass transport system, its effect is not fully known until the characteristics of a specific air inlet system are known.

The preferred container 12 defines the reservoir to enclose the solid phase ferrocene on all sides except one. Thus, the connecting means or cover plate 26 closes the reservoir 18, leaving a flow orifice 24 on a single side of the reservoir. This metering technique offers substantial advantages over the use of a sublimer, as known in the prior art, which requires a through flow of gas from the inlet stream. In addition, in a sublimer typically it is critical that the surface area of the ferrocene be controlled, which presents special difficulties and may limit the useful physical form of the ferrocene to pellets. However, in the present invention a primary advantage is that the ferrocene bed or reservoir can be maintained at a constant temperature during all phases of operation. For example, the present injector has no need to compensate for variable and uncontrollable surface area of the ferrocene source, which may be crystals, pellets, sticks, or a solidified mass or block formed in the reservoir from a melt. The use of a solid mass is highly desirable from the standpoint of efficient use of reservoir volume. Further, it is unnecessary to control the temperature of air, fuel or motive gas passing through a ferrocene bed as would be the case with use of a sublimer. The invention permits an increase in the transport of the ferrocene through the holes 24 in the cover plate 26 of the ferrocene reservoir 18 as the inlet stream air flow increases, due to the convective component of the diffusive/convective mass transport mechanism. Thus, the injector is a true ferrocene metering device without the necessity of complex computer controls and flow sensors.

While the embodiment of injector 10 shown in FIG. 1 is extremely simple, tests have shown it to be effective. Many variations of this injector are possible, and the embodiment of FIGS. 2–4 incorporate numerous examples of added features. Some or all could be used selectively in combination with the embodiment of FIG. 1.

Figure 2:
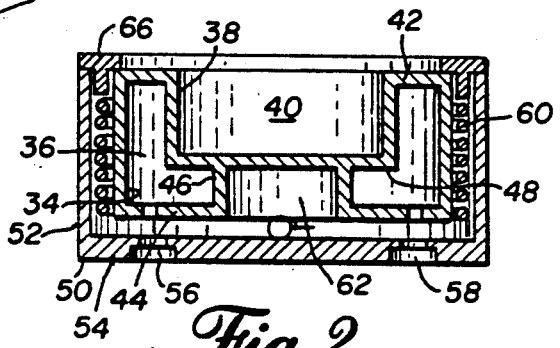
FIG. 2 is a side view in cross-section, showing a second embodiment of the injection system.
Figure 3:
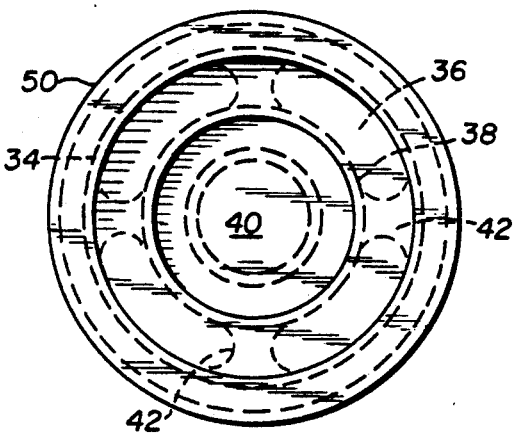
FIG. 3 is top view of the injector of FIG. 2.
Figure 4:
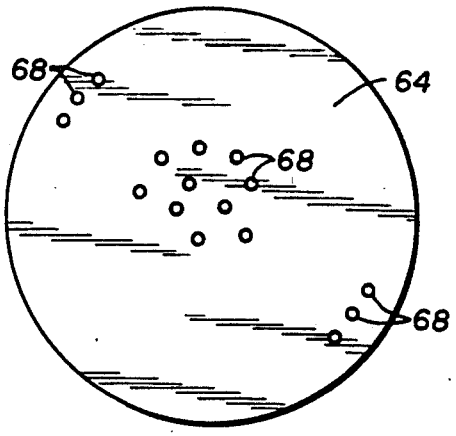
FIG. 4 is a top view of the cover plate containing flow orifices.

According to the embodiment of FIGS. 2–4, the container or cup 12 of the injector is formed to define two reservoirs so that the injector 10 can perform both a conditioning and a maintenance function, as more fully described in U.S. Pat. No. 4,389,220, issued Jun. 21, 1983, and incorporated herein by reference for that teaching. The container is formed in part of a first cylindrical wall 34 that defines the outer side wall of the container and of a first, annular reservoir 36. A second cylindrical wall 38 of smaller diameter than the first wall 34 is located concentrically within the first wall. This second wall defines the outer side wall of a second, central reservoir 40. The two cylindrical walls may be connected and maintained in spaced relationship by radial webs 42 that occupy only a minor portion of the area between the two walls so that ferrocene in the first reservoir has substantial open exposure to the top of the first reservoir.

The container 12 is closed at its bottom face by a first base 44. This base may have a central opening, with the result that it closes only the bottom side of the first reservoir. An upwardly directed annular flange or tube 46 is connected to this base at the periphery of the opening and extends upwardly toward the second reservoir 40. A second base 48 closes the bottom of the second reservoir and is spaced from the first base, except that the tube 46 closes the bottom face of the container against the second base.

In this embodiment, the means for maintaining an elevated reservoir temperature may include a jacket or outer shell 50. The jacket includes a cylindrical side wall 52 of larger diameter than wall 34 and concentric therewith so as to define a space between the jacket wall and side wall 52. The jacket also includes a base wall 54 that is spaced from bottom wall 44 and closes the bottom of the shell. However, bottom wall 54 but may be provided with access openings 56 and 58, suitable for passage of fluids or wires. Thus, the reservoirs can be heated by engine fluid or by an electrical heater 60 located in the space between shell 50 and the side wall of container 12. For example, the heater 60 may be of a type having wound coils of resistance wire wrapped around wall 34. Another portion of the heater may be a thermostat 62 located in tube 46, where the thermostat is in sensing contact with both reservoirs. By measuring either or both reservoir temperatures, the thermostat can control the operation of the electrical heater and maintain a constant or varied temperature. Constant temperature operation of the heater requires merely that the wire be connected to an electric current source that is active when the engine is in operation. Variable temperature control optionally could be employed and may be appropriate in a situation where better load responsive performance of the injector is important. Increasing or decreasing the temperature would effect the mass transport mechanism by correspondingly increasing or decreasing the vapor pressure of ferrocene in the reservoir. Thus, for example, engine conditioning could be achieved by employing higher reservoir temperature for a limited time instead of employing a second reservoir.

As in the embodiment of FIG. 1, the top or open face of the container is operatively connected to the air inlet system of an engine. This connection is by a cover plate 64 closing the top face of the reservoir except at the fluid orifices. The cover plate is held in place by a hold down collar 66 joined to the top edge of the outer shell, such as by a threaded connection. The hold down collar at least partially covers the top face of the container and a peripheral portion of the cover plate.

The injector of FIGS. 2–4 may be quite small, such as about 1.25 inches in height and 2.375 inches in diameter. The first, annular reservoir may have a volume of about 20.4 cc and a surface area of about 0.97 in$^2$. The second, center reservoir may have a volume of about 10.5 cc and a surface area of about 1.25 in$^2$. Due to this small size of the injector, the connection of this injector with the inlet air stream of an engine or other combustion device may be by locating the entire injector in passageway or duct 32.

Because the reservoirs in the embodiment of FIGS. 2–4 are separated by a barrier, such as wall 38, the cover plate provides at least one separate fluid orifice 68 for each reservoir. The number and size of the orifices 68 can be varied according to the requirements of each application and according to the operative diffusive and convective characteristics.

With two reservoirs and two metering systems, the injector of FIGS. 2–4 can first condition an engine by supplying a high dose of ferrocene for an initial period, such as from the combined first and second reservoirs, to establish a catalytic coating on the combustion surfaces. After the center reservoir is exhausted, a relatively lower dose is supplied on a long term basis from the larger annular side reservoir to maintain the established coating. Typically the conditioning dose is supplied from about 50 to 200 ppm with 100 ppm being preferred. The maintenance coating is supplied at a far lower concentration, with the preferred being about 20 ppm.

Because both diffusion and convection effect the metered delivery of ferrocene vapor, empirical study best determines whether the flow orifices are of the proper size to deliver the desired dose. Diffusive transport can be calculated to yield the following relationship between the total diameter of the diffusive orifices required to meter 25 ppm and the other operating parameters:

Total Area =

$$(3.58 \times 10^{-10}) \times (10^{1840/T}) \sqrt{\left(\frac{v}{Y}\right)\left(\frac{T\,\Delta Z}{D_{Fa,N2}}\right)\left(\frac{P_{N2}}{P_T}\right)}$$

where $D_{Fa,N2}$=, diffusivity of ferrocene in air (nitrogen); $P_{N2}$=partial pressure of air (nitrogen); $P_T$=total pressure of the system; T temperature of ferrocene reservoir; V=speed of car in mph; Y=mpg; $\Delta Z$=cover plate thickness. However, in actual operation the dominant contribution is from convective transport in addition to diffusive transport. Generally the details of the convective environment are not known until the injector is installed. At that time, generally it will be desirable to down-size the flow orifice as calculated for diffusion alone.

Figure 5:
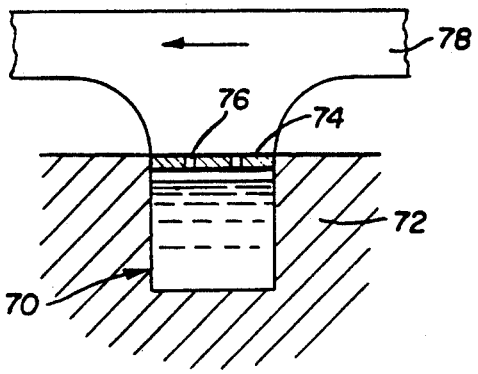
FIG. 5 is a side view in cross-section, showing a third embodiment of the injection system.

With reference to FIG. 5, a passive injector reservoir 70 is incorporated into the original design of an engine or other combustion apparatus and provides an effective and efficient application of the invention. The engine block 72 is formed to define a cavity within the body of the block. For example, the cavity can be formed during the original casting of the block, or it may be formed later by drilling. Thus, the block itself is the container and the cavity is filled with a melt of ferrocene, which solidifies in place. A cover plate 74 is installed over the top of the cavity, such as by being pressed into the mouth of the cavity. The cover plate defines one or more suitably sized orifices 76, which are exposed to and in communication with the air stream within intake duct 78, which may be an intake manifold.

The injection system of FIG. 5 is especially desirable, since the engine block also serves to transmit normal engine operating heat to elevate the reservoir temperature and does not require special electrical or fluid connections. The thermostat for the engine cooling system maintains the desired constant reservoir temperature. In addition, since the injector is located in a predetermined position in all engines of the same design, the convective flow characteristics applicable to the injector in this air intake system can be accurately predetermined for the entire line of engines and intake systems. As a result, orifice size can be properly determined for all such engines for the combined diffusive/convective mechanisms.

While the embodiment of FIG. 5 has been described as applied to engines, the same concepts can be extended to boilers and other combustion equipment. For example, the reservoir could be formed in a burner casing at a point known to reach a desired temperature during normal operation.

The following examples illustrate the performance of the injector.

EXAMPLE 1

This example evaluated performance of the injector under conditions of steady speed and load on an engine. Substantially all expressway driving was used in a fixed speed load test.

A 1992 Cadillac Sedan DeVille with a 4.9 liter fuel injected engine with 23 miles on the odometer at the beginning of the test drive was used to demonstrate the performance of the injector. The test was conducted at expressway speeds in the Denver, Colo., USA, area. Prior to the installation of the injector in the air intake of the vehicle, the base line fuel economy of the vehicle was measured as follows:

| Phase A Test Results | | |
|---|---|---|
| Miles Travelled | MPG Achieved | Average |
| 189.6 | 21.29 | |
| 172.6 | 20.50 | 20.59 ± .67 |
| 177.0 | 19.95 | |

A prototype injector was similar to that of FIGS. 2–4, having 10 each 3/32 inch holes plus one-half of a 7/16 inch hole in the plate over the inner (center) chamber and having 10 each 7/64 inch holes in the plate over the outer chamber. The performance of the vehicle was measured with the injector installed on top of the filter in the air cleaner of the engine, on the clean air side leading to the engine, and with the electrical leads connected to a 12 volt ignition switched wire, supplying 12 volts to the heater only when the ignition switch is in the "on" position. The heater was operated in the approximate temperature range from 170°–180° F. Mpg results were:

| Phase B Test Results | | |
|---|---|---|
| Miles Travelled | MPG Achieved | Average |
| 114.1 | 23.56 | |
| 117.4 | 24.51 | 23.75 ± .69 |
| 126.4 | 23.18 | |

A cover plate with no holes, shutting off ferrocene flow, was installed, although the electrical heater continued to operate, and the test continued:

| Phase C Test Results | | |
|---|---|---|
| Miles Travelled | MPG Achieved | Average |
| 96.4 | 21.95 | |
| 69.8 | 22.39 | 22.45 ± .53 |
| 158.8 | 23.0 | |

There is no significant difference in the letter two sets of results, confirming that the catalytic engine coating is responsible for the ferrocene derived improvement in fuel economy.

To confirm that the improved fuel economy was indeed due to the catalytic coating from ferrocene from the prior injection period, a chemical removal of the catalytic coating in the combustion chamber was achieved by adding a small quantity of 1,1,1 trichloroethylene into the air intake of the engine while running at no load and 2,000 rpm for 30 seconds. This generates HCl in the combustion chamber and passivates the iron catalytic coating. The vehicle, with the injector with the solid plate installed still connected to the electrical system was then run for two more test loops with the following results:

| Phase D Test Results | | |
|---|---|---|
| Miles Travelled | MPG Achieved | Average |
| 75 | 19.90 | |
| 74.5 | 20.59 | 20.25 ± .49 |

Since fuel economy returned to the initial baseline value, the improved fuel economy was a direct result of the use of the injector. The configuration of the diffusion/convection orifice plate for this test resulted in the addition of 1.475 gm from the inner (central) chamber and 2.60 gm from the outer chamber, providing a 42 ppm dose rate of ferrocene during Phase B of the test. A weight change of only 0.1 gm was observed during Phase C, with the non-perforated plate installed.

EXAMPLE 2

This test evaluated injector performance under variable engine speed and load. The test was conducted over mostly two lane road, on a non-expressway route having many towns. Thus, the engine operated with variable speeds and load, frequently having to accelerate or decelerate. One purpose of the test was to evaluate the accuracy of the theory that the injector need not be an instantly responding device. Instead, the injector should operate very well by providing ferrocene to the engine on the basis of long term average requirement.

A second Cadillac, substantially identical to the one described in Example 1 and having only 6 miles on the odometer, was used for the second demonstration performance. The area of the metering orifices was changed for this test to come closer to the desired 25 ppm continuing dose from the outer chamber. The total area from the outer chamber was increased to $8.5\times10^{-2}$ in$^2$ by using 9 holes of 7/64 diameter. The center chamber was used for the conditioning dose by putting 0.96 gm ferrocene in the center reservoir and using 14 holes of 7/64 inch size and 3 holes of 3/32 inch size. The test protocol was a cross over design conducted over a 1,785 mile loop on highway US 36 between Denver, Colo., USA, and Springfield, Ill. ,USA. The entire test was conducted with the injector in place on top of the air filter, in the air intake. The electrical leads were only connected one-half of the time and chemical deconditioning of the engine was used after the first injector activation period to return the mpg to baseline for the return and crossover portion of the driving test. The vehicle was operated at an average speed of about 55 mph. Cruise control was used where permitted by traffic. The results are as follows:

| Test Segment | MPG | Trip Miles | Ambient Temp. | Segment Speed | Direction | Injector Connected |
|---|---|---|---|---|---|---|
| 1. | 18.8 | 127 | 56 | 75 | E | No |
| 2. | 22.6 | 101 | 61 | 43 | E | No |
| 3. | 20.0 | 93 | 67 | 68 | E | No |
| 4. | 18.2 | 91 | 76 | 55 | E | No |
| 5. | 23.1 | 111 | 80 | 65 | E | Yes |
| 6. | 18.1 | 116 | 79 | 46 | E | Yes |
| 7. | 18.3 | 119 | 83 | 69 | E | Yes |
| 8. | 25.2 | 131 | 82 | 49 | E | Yes |
| 9. | 19.6 | 132 | 70 | 78 | W | No |
| 10. | 19.7 | 119 | 76 | 66 | W | No |
| 11. | 20.0 | 111 | 80 | 46 | W | No |
| 12. | 18.4 | 113 | 78 | 58 | W | No |
| 13. | 21.2 | 93 | 76 | 55 | W | Yes |
| 14. | 21.1 | 93 | 74 | 68 | W | Yes |
| 15. | 19.8 | 102 | 69 | 70 | W | Yes |
| 16. | 22.6 | 129 | 83 | 32 | W | Yes |

The results were analyzed by a linear regression results model:
MPG = 24.9 + 2.6 Injector + 0.49 Daytime − 0.15 Temperature
MPG without injector = 19.1
MPG with injector = 21.7
Correlation coefficient = .557
Significance >95%

Within a 95% confidence level, this example showed a 13.6% improvement in mpg during injector use, and the actual dose of ferrocene from the outer chamber was 24 ppm. A comparison of results in examples 1 and 2 demonstrates that the injector operates in the expected manner. Examples 1 and 2 primarily differ in the driving pattern of two different road types. Example 1 offered steady, high speed operation on expressways, while example 2 offered lower average speed and much more frequent stop/acceleration driving pattern of a two lane highway. In spite of this substantial difference in speed load profile, the ferrocene injection system is equally effective for both demonstrations, confirming that average ferrocene addition rate relative to average fuel consumption rate is completely effective.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A ferrocene injection system, comprising:

a container defining therein a reservoir;

a quantity of solid phase ferrocene in said reservoir;

a means for maintaining an elevated reservoir temperature sufficient to produce a repeatable vapor pressure of ferrocene within the reservoir;

a means for connecting said reservoir, in use, to the air inlet system of a combustion device, wherein said connecting means defines a flow orifice supplying ferrocene vapor therethrough at least by diffusion.

2. The ferrocene injection system of claim 1, wherein said solid phase ferrocene is of at least 95% minimum purity.

3. The ferrocene injection system of claim 1, wherein said reservoir encloses the solid phase ferrocene on all sides except one.

4. The ferrocene injection system of claim 3, wherein said connecting means comprises a cover plate closing said reservoir, and said flow orifice is on a single side of the reservoir.

5. The ferrocene injection system of claim 1, wherein said means for maintaining an elevated reservoir temperature comprises:

a jacket on said container near the reservoir and having an inlet and an outlet for, in use, receiving a circulating supply of a hot fluid.

6. The ferrocene injection system of claim 1, wherein said means for maintaining an elevated reservoir temperature comprises an electrical heater.

7. The ferrocene injection system of claim 6, wherein said means for maintaining an elevated reservoir temperature further comprises a thermostat measuring reservoir temperature and, in response, controlling the operation of the electrical heater.

8. The ferrocene injection system of claim 1, wherein said container further comprises a barrier dividing the container into first and second reservoirs, and said connecting means defines separate orifices connecting each reservoir, in use, with the air inlet system of a combustion device.

9. The ferrocene injection system of claim 8, wherein said container comprises:

a first cylindrical wall defining the outer side wall of said first reservoir;

a second cylindrical wall of smaller diameter than said first wall, located concentrically within the first wall, and defining the outer side wall of said second reservoir;

a first base closing the bottom side of the first reservoir; and a second base closing the bottom side of the second reservoir.

10. The ferrocene injection system of claim 9, wherein said means for maintaining an elevated reservoir temperature comprises:

an outer shell having a cylindrical side wall of larger diameter than said first cylindrical wall and concentric therewith, and a base wall closing the bottom of said shell.

11. The ferrocene injection system of claim 10, wherein said connecting means comprises:

a cover plate closing the top face of said container; and further comprising:

a hold down collar connected to the top edge of said outer shell and at least partially covering the top face of the container and a peripheral portion of said cover plate.

12. The ferrocene injection system of claim 10, wherein said means for maintaining an elevated reservoir temperature further comprises a wound resistance wire heater located between said outer shell and the container.

13. The ferrocene injection system of claim 12, wherein:

said first and second bases are spaced apart;

the first base defines a central opening opposite from the second base;

a cylindrical tube connects the first and second bases at the periphery of said central opening; and wherein said means for maintaining an elevated reservoir temperature further comprises a thermostat located in said tube.

14. The ferrocene injection system of claim 1, wherein said container comprises an engine block.

15. The ferrocene injection system of claim 14, wherein said means for maintaining an elevated reservoir temperature comprises a thermostat within the cooling system of said engine block.

16. A ferrocene injection system for use in combination with a combustion device having an inlet air stream, comprising:

a container defining therein a reservoir;

a quantity of ferrocene in said reservoir;

a means maintaining an elevated reservoir temperature producing a repeatable vapor concentration of ferrocene within the reservoir; and a means for connecting said reservoir to an inlet air stream of a combustion device and defining a flow orifice supplying ferrocene vapor into the air stream at least by diffusion.

17. The ferrocene injection system of claim 16, further comprising:

an air stream inlet duct supplying combustion air to a combustion device, wherein said flow orifice is positioned within said duct and supplies ferrocene vapor into the air stream by convection induced by the air stream.

18. The method of delivering ferrocene to the combustion zone of a combustion device having an inlet air stream, comprising:

providing a reservoir containing a quantity of ferrocene;

maintaining said reservoir at a temperature producing a repeatable vapor concentration of ferrocene within the reservoir; and metering said vapor of ferrocene into the air stream by providing a flow orifice between the reservoir and the inlet air stream of the combustion device;

wherein said flow orifice is sized to supply an average ferrocene dose relative to the average fuel throughput of the combustion device.

19. The method of claim 18, wherein said reservoir is maintained at a temperature within the approximate range from 170°-200° F.

20. The method of claim 18, wherein said step of metering the vapor of ferrocene is by diffusion and convection.

* * * * *